US007192184B2

(12) United States Patent
Hiranuma et al.

(10) Patent No.: US 7,192,184 B2
(45) Date of Patent: Mar. 20, 2007

(54) PORTABLE WATCH

(75) Inventors: Haruki Hiranuma, Chiba (JP); Nobukazu Oomori, Chiba (JP)

(73) Assignee: Seiko Instruments Inc. (JP)

( * ) Notice: Subject to any disclaimer, the term of this patent is extended or adjusted under 35 U.S.C. 154(b) by 203 days.

(21) Appl. No.: 10/965,122

(22) Filed: Oct. 14, 2004

(65) Prior Publication Data

US 2005/0088920 A1 Apr. 28, 2005

(30) Foreign Application Priority Data

Oct. 23, 2003 (JP) ..... 2003-362728

(51) Int. Cl.
*G04B 29/00* (2006.01)

(52) U.S. Cl. ..... 368/319; 368/308

(58) Field of Classification Search ..... 368/190–195, 368/319–321, 206, 216, 288–290
See application file for complete search history.

(56) References Cited

U.S. PATENT DOCUMENTS 2,309,428 A * 1/1943 Aegler ..... 368/288
2,482,317 A * 9/1949 Borer ..... 368/288
3,453,819 A * 7/1969 Simon ..... 368/290
4,089,158 A * 5/1978 Wenger ..... 368/216
4,313,187 A * 1/1982 Waki et al. ..... 368/319
5,383,166 A * 1/1995 Gallay ..... 368/288
2002/0167866 A1* 11/2002 Oomori et al. ..... 368/191
2005/0094498 A1* 5/2005 Koshoji et al. ..... 368/319

FOREIGN PATENT DOCUMENTS

JP 57046181 3/1982

* cited by examiner

*Primary Examiner*—Vit Miska
*Assistant Examiner*—Sean Kayes
(74) *Attorney, Agent, or Firm*—Adams & Wilks

(57) ABSTRACT

A portable timepiece has a pipe extending from a case and a winding stem for transmitting a rotational force to a timepiece movement in the case. A crown is connected to the winding stem for rotational movement therewith and for detachable engagement with an outer periphery of a male threaded section of the pipe to prevent unintentional rotation of the crown. The crown has a crown shaft for rotating the winding stem, a crown head having a female threaded section for threaded engagement with the male threaded section and mounted for undergoing rotation to rotate the crown shaft in a state in which the engagement between the male and female screw sections is released. A clutch couples together the crown shaft and the crown head to prevent rotation of the crown shaft in a state in which the male and female threaded sections are engaged with one another and couples the crown shaft and the crown head to allow the crown shaft to rotate during rotation of the crown head in a state in which the male and female threaded sections are not engaged with one another.

14 Claims, 6 Drawing Sheets

PORTABLE WATCH

BACKGROUND OF THE INVENTION

1. Field of the Invention

The present invention relates generally to portable timepieces and, more specifically, to a portable watch in which a crown is held so as not be turned unintentionally or carelessly by utilizing engagement of screws.

2. Description of the Prior Art

Conventionally, a crown for operating a watch movement incorporated in a case band is a single component and includes a crown shaft section that moves the watch movement in association with the crown shaft section and a crown head that is formed integrally with the crown shaft section. The crown shaft section is inserted in a winding stem pipe, which is attached to the case band, and the crown head is fitted into a pipe end, which is located outside the case band, of the winding stem pipe.

There is known a portable watch in which, in order to prevent this crown from being turned carelessly, a male screw section is formed on an outer periphery of the pipe end, which is located outside the case band, of the winding stem pipe, and a female screw section is formed in the crown head to detachably engage the male screw section at the pipe end (see JP-A-57-46181 (page 1, right column, line 8 to page 2, left column, line 7, and FIGS. 1 and 2)).

In this portable watch, in a normal state in which the watch movement is not operated, the crown is engaged with the male screw section of the pipe to bring the crown head into abutment against an outside surface of the case band, whereby careless turn of the crown can be controlled. An operation for holding the crown so as not to be turned carelessly will be hereinafter referred to as a screw lock operation, and a state in which the crown is held will be hereinafter referred to as a screw lock state. In addition, when the watch movement is operated, the winding stem connected to the watch movement can be turned together with the crown after the engagement of the crown with the male screw section is released to bring the crown into a pulled state.

Incidentally, a mechanical portable watch, in which a watch movement operated by a winding stem has a spiral spring as a drive source, is made such that, in a state in which a crown is arranged in a position where the crown is not pulled out, the spiral spring is wound up by a turning operation for this crown. In addition, a portable watch, in which a watch movement operated by a winding stem has plural operation modes, is made such that, in a state in which a crown is arranged in a position where the crown is not pulled out, the operation modes are switched by a turning operation for this crown.

A state in which a crown is arranged in a position where the crown is not pulled out is generally referred to as a "zero stage". On the other hand, a position where the crown is pulled out for calendar adjustment or the like is generally referred to as a "first stage". There is also known a portable watch in which, depending upon a situation, a crown can be pulled out to a pulled-out position of a "second stage" that is a position for time setting.

It is undesirable to apply the technique of the JP-A-57-46181 to a portable watch, which has a function of winding up a spiral spring with a crown arranged in a "zero stage", or a portable watch, which has a function of changing an operation mode, due to the following reasons.

That is, in the portable watch of the JP-A-57-46181, the crown shaft section and the crown head are integrally formed. Thus, in the screw lock operation for engaging the crown in the male screw section of the winding stem pipe, since the crown shaft section is also turned, the winding stem connected to this crown shaft section is also turned together with the crown.

Consequently, in the application of the present invention to the portable watch having the function of winding up the spiral spring, the spiral spring is wound up as the crown is engaged with the male screw section of the winding stem pipe. A winding-up operation for the spiral spring is performed by manual winding or automatic winding. However, it is impossible to know in which winding state the spiral spring in the case band is. Therefore, in a state in which the spiral spring is wound up to a considerable degree, the screw lock operation with respect to the crown may be performed. In this case, the screw lock operation becomes particularly heavy, which is inconvenient. Accordingly, an excessive operation force is applied to the male screw section and the female screw section, and abrasion of these screw sections is accelerated.

Further, in the application of the present invention to the portable watch having the function of changing an operation mode, an operation mode is changed freely following the screw lock operation with respect to the crown. Consequently, the technique, which utilizes engagement of screws to prevent a crown from being turned carelessly, cannot be applied to the portable watch of this type.

A problem that the present invention is to solve is in providing a portable watch in which a crown can be held so as not to be turned carelessly utilizing engagement of screws without being restricted by a function of a watch movement, durability can be improved, and a screw lock operation for the crown is light.

SUMMARY OF THE INVENTION

In order to solve the problem, the present invention is a portable timepiece, such as a portable watch, in which a crown is held so as not to be turned carelessly utilizing engagement of screws, the crown including: a crown shaft that moves a winding stem in association with the crown shaft; a crown head that has a female screw section to be detachably engaged with a male screw section of a pipe attached to a case band and turns the crown shaft in a state in which this engagement is released; and a clutch that couples the crown shaft and the crown head so as to prevent turn of the crown shaft in a state in which the engagement is completed, and couples the crown shaft and the crown head so as to make it possible to turn this crown shaft following the crown head in a state in which the engagement is released.

In the present invention, by releasing the engagement of the female screw section of the crown head with the male screw section of the pipe, restraint of the crown head is released to allow this crown head to turn, and a relative position of the crown head and the crown shaft with respect to the axial direction changes, and the crown head and the crown shaft are coupled by the clutch. Consequently, a turning operation for the crown head under this coupling state is transmitted to the crown shaft via the clutch. Consequently, as the winding stem is turned, the watch movement in the case band can be operated. After this operation, the crown head is moved in the axial direction so as to come closer to an outside surface of the case band, and the female screw section of the crown head is engaged with the male screw section of the pipe, whereby the coupling by the clutch is released, and then the crown head comes into abutment against the outside surface of the case band to come into the screw lock state. In this way, immediately before the engagement of the crown head with respect to the pipe is completed, the crown head and the crown shaft are coupled again by the clutch. Thus, at a point when the engagement is completed immediately after this re-coupling, the turn of the crown shaft is prevented by the crown head held in the screw lock state. In this case, with the screw lock operation for obtaining the screw lock state, the crown head and the crown shaft are not coupled until the engagement is about to be completed. Thus, it is possible to control the crown shaft not to turn to transmit the turn to the watch movement following the screw lock operation.

In a preferred form of the present invention, the clutch includes: first and second driven sections, which are formed in a polygon or a gear shape and provided in parallel to each other in an axial direction of the crown shaft apart from an outer periphery of the crown shaft by a dimension of movement in the axial direction of the crown head; and a driving section that has a fitting hole of the same shape as these driven sections, is provided in the crown head, and is detachably engaged with the first and the second driven sections following the movement in the axial direction of the crown head. Thus, the present invention is excellent in that a structure of the clutch is simple.

In a preferred form of the present invention, a shaft portion between the first and the second driven sections are formed in a size to be inscribed in the fitting hole. Thus, the present invention is excellent in that, in moving the crown head in the axial direction, the driving section is guided to the shaft portion between the first and the second driven sections, and the crown head can be moved in the axial direction easily while controlling fluctuation in a posture of the crown head such as inclination.

In a preferred form of the present invention, the driving section is made of a ring that is fixed to an inner periphery of the crown head. Thus, the present invention is excellent in that a joint trace, which appears on a visually recognizable end face of the crown head, is preferable in appearance because the joining trace can contribute to giving impression that the crown head is machined with a lot of trouble.

In a preferred form of the present invention, the driving section is provided integrally with the crown head. Thus, the present invention is preferable in that there is no deficiency in coupling of the crown shaft and the crown head based on attachment deficiency of the driving section to an inner surface of the crown head, and the function of the clutch can be maintained surely for use in a long period.

In a preferred form of the present invention, a receiving section, which an end of the female screw section comes into contact with and separates from following the movement in the axial direction of the crown head in a state in which the engagement of the male screw section and the female screw section is released, is provided on an outer periphery of the crown shaft closer to an outside surface of the case band than the clutch. Thus, the crown head is positioned with respect to the axial direction of the crown shaft with the end of the female screw section hooked on to the receiving section.

In a preferred form of the present invention, the receiving section and the driving section are arranged so as to be opposed to each other in the axial direction, and an elastic body, which biases the crown head in a direction in which the crown head moves away from the outside surface of the case band, is provided between the receiving section and the driving section. Thus, the present invention is excellent in that, simultaneously with the engagement of the male screw section and the female screw section being released, the crown head is moved in the axial direction by a biasing force of the elastic body so as to hook the end of the female screw section on the receiving section, and the driving section is positioned with respect to the second driven section by the hook, whereby the crown shaft and the crown head can be coupled such that the crown shaft can turn.

BRIEF DESCRIPTION OF THE DRAWINGS

A preferred form of the present invention is illustrated in the accompanying drawings in which.

DETAILED DESCRIPTION OF THE PREFERRED EMBODIMENTS

First Embodiment

A first embodiment of the present invention will be explained with reference to FIGS. 1 to 5.

Figure 1:
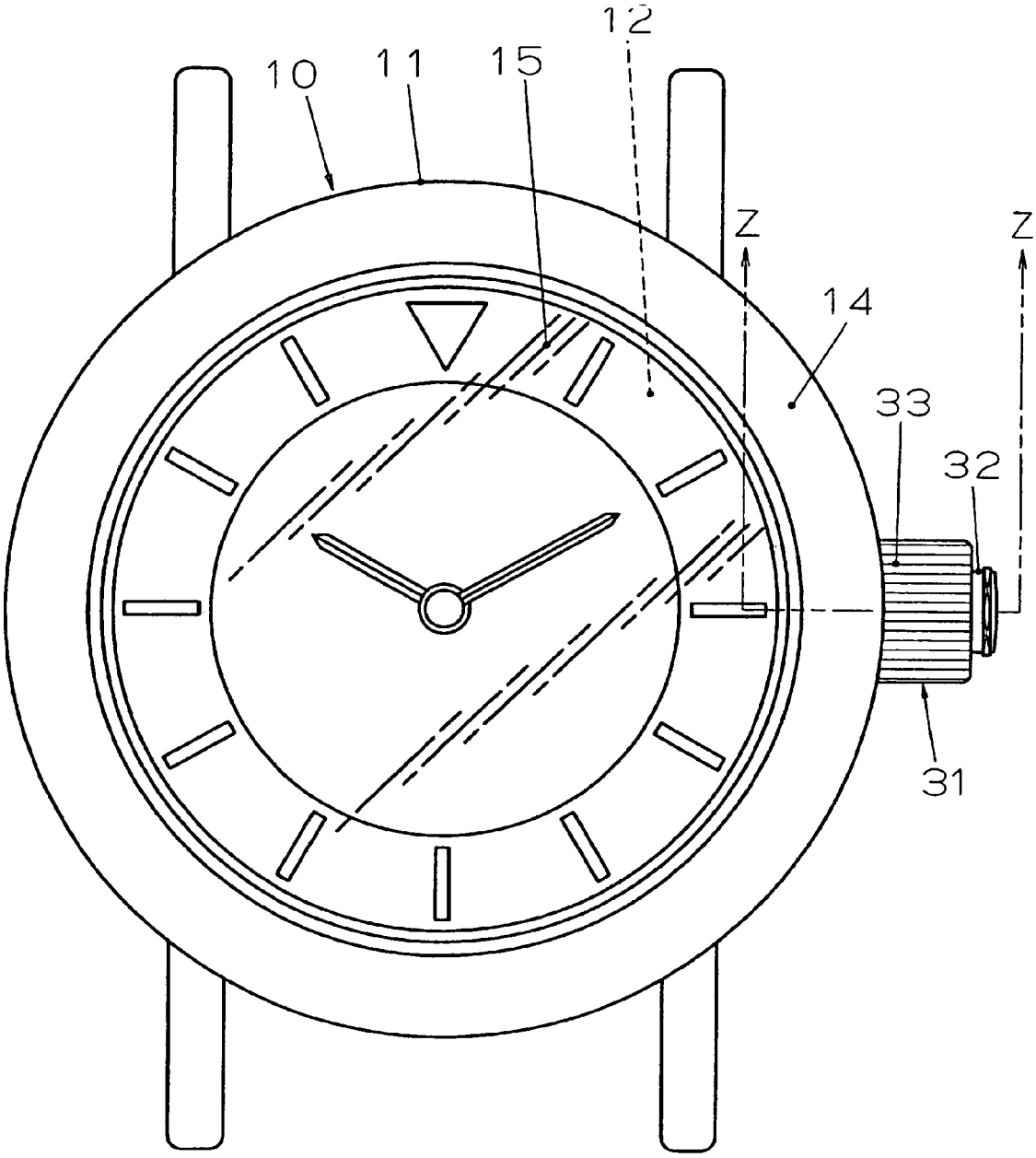
FIG. 1 is a front view showing a wristwatch in accordance with a first embodiment of the present invention.
Figure 2:
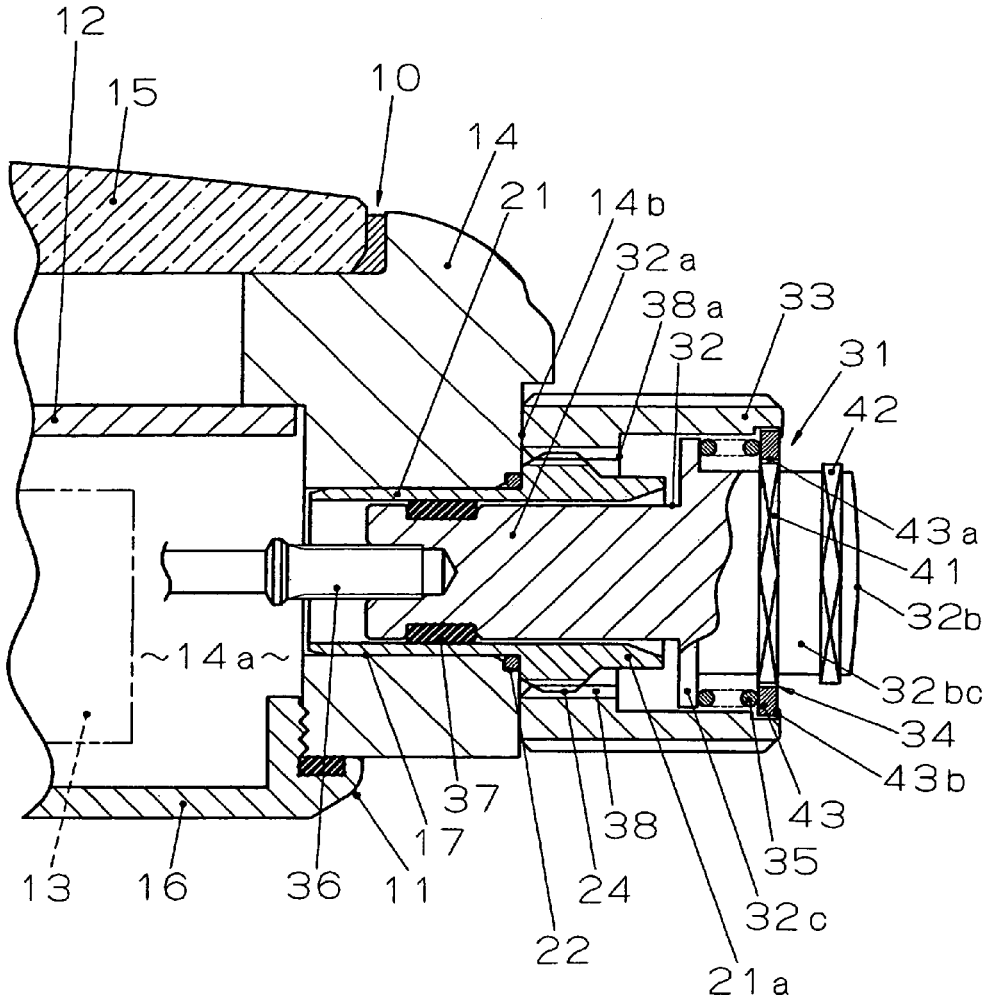
FIG. 2 is a sectional view showing a screw lock state of a crown along a line 2—2 in FIG. 1.
Figure 3:
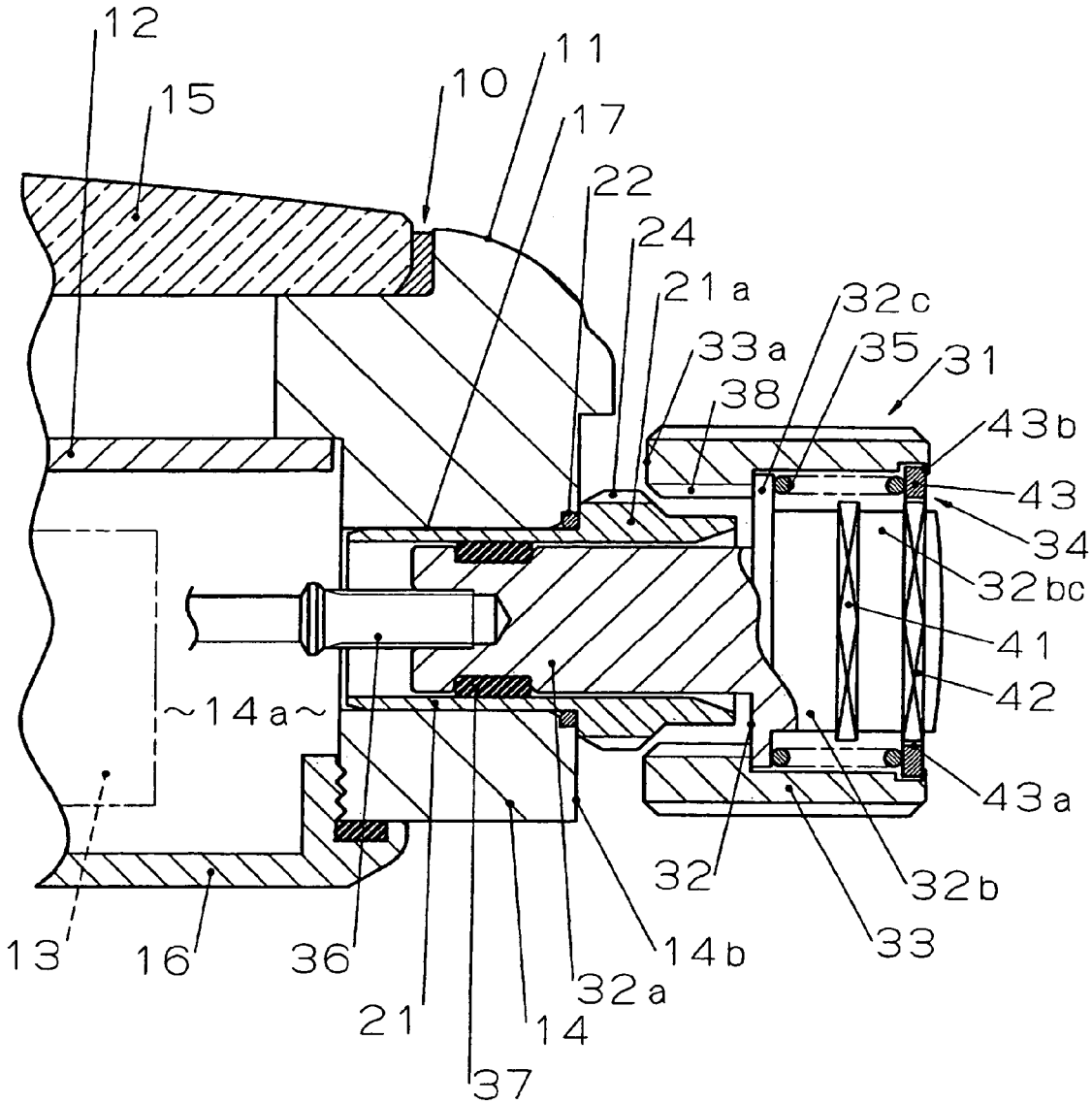
FIG. 3 is a sectional view showing a state in which the screw lock state of the crown shown in FIG. 2 is released.

In FIG. 1, reference numeral 10 denotes a wristwatch as a portable clutch. As shown in FIGS. 2 and 3, this wristwatch 10 houses a dial 12, a watch movement 13, and the like in a case or watch exterior assembly 11. As the watch movement 13, a mechanical watch movement of a manual winding type with a spring as a drive source, an automatic winding type, or a type using both manual winding and automatic winding is used. Note that instead of these watch movement types, a watch movement of a type which can select and a switch a digital display and an analog display as a time display or the like on the dial 12 may be adopted.

As shown in FIGS. 2 and 3, the watch exterior assembly 11 is formed by mounting a cover glass 15 liquid-tightly on a front surface, which consists of one surface in a thickness direction, of an annular metal case band 14, and screwing a case back 16 consisting of metal or the like liquid-tightly onto a rear surface, which consists of the other surface in the thickness direction, of the case band 14. The dial 12 is visually recognizable through the cover glass 15. The case back 16 is removable.

As shown in FIGS. 2 and 3, a pipe attachment hole 17, which pierces this case band 14 in a radial direction, is opened in a part of the case band 14. One end of the pipe attachment hole 17 opens into a space 14*a* surrounded by the case band 14, and the other end of the pipe attachment hole 17 is opened to an outside surface 14*b* of the case band 14.

A tubular member (first tubular member) in the form of a pipe 21 is inserted into the pipe attachment hole 17 from the outside of the case band and is attached to the case band 14 by brazing or the like. In FIGS. 2 and 3, reference numeral 22 denotes a brazing material. The pipe 21 is made of a metal, such as for example stainless steel, is formed in a cylindrical shape and opened at both ends in an axial direction thereof, respectively, includes a pipe end 21*a* arranged outside the case band 14, and has a male screw section 24 for holding a crown 31 in the screw lock state on an outer periphery of the pipe end 21*a*.

The crown 31 includes a crown shaft 32, a crown head 33, a clutch member 34 (hereinafter "clutch"), and an elastic body, for example, a coil spring 35.

The crown shaft 32 is made of, for example, metal, preferably stainless steel. As shown in FIGS. 2 and 3, the crown shaft 32 includes: a columnar inserting shaft section 32*a* that is inserted into the pipe 21 from the outside of the case band 14; a shaft end 32*b* that continues integrally with this inserting shaft section 32*a* and is arranged in the outside of the pipe 21; and a receiving section 32*c* that is provided forming a boundary between the inserting shaft section 32*a* and the shaft end 32*b*. The receiving section 32*c* is provided closer to the outside surface 14*b* of the case band 14 than the clutch 34.

A winding stem 36, which transmits a turning force of the crown 31 to the watch movement 13, is screwed from the inside of the case band and coupled to a tip of the inserting shaft section 32*a*. Consequently, the winding stem 36 and the crown shaft 32, which are coupled to each other, cannot move in the axial direction. An annular waterproof gasket 37, which consists of an elastic material such as rubber, is inserted in an annular recess formed on an outer periphery of the tip of the inserting shaft section 32*a*. This gasket 37 elastically adheres to the annular recess and an inner periphery of the pipe 21. Consequently, a part between the inner periphery of the pipe 21 and the crown shaft 32 is waterproofed.

The shaft end 32*b* has a diameter larger than the inserting shaft section 32*a*. The receiving section 32*c* is provided forming an annular brim. This receiving section 32*c* has a diameter larger than outer diameters of the shaft end 32*b* and the male screw section 24.

The crown head 33 is made of, for example, metal, preferably, stainless steel and is formed in a cylindrical shape as shown in FIGS. 2 and 3, and has a groove for-preventing slippage in a turning operation on an outer periphery thereof. Moreover, one end face 33*a* of the crown head 33 is formed as a surface that comes into contact with and separates from the outside surface 14*b* of the case band 14. A female screw section 38, which is removably engaged with the male screw section 24 in order to obtain the screw lock state, is formed on an inner periphery closer to this one end face 33*a*. A diameter of the female screw section 38 is smaller than the diameter of the receiving section 32*c*, and an end 38*a* (see FIG. 2) of this female screw section 38 can come into contact with and separate from the receiving section 32*c*.

The clutch 34 is adapted to couple the crown shaft 32 and the crown head 33 so as to prevent the turn of the crown shaft 32 in a state in which engagement of the male screw section 24 and the female screw section 38 is completed (this coupling will be hereinafter referred to as a first coupling state), couples the crown shaft 32 and the crown head 33 so as to make it possible to turn the screw shaft 32 following the screw head 33 in a state in which the engagement is released (this coupling will be hereinafter referred to as a second coupling state), and releases the coupling in states other than the two states. For this purpose, the clutch 34 has, for example, a first driven section 41, a second driven section 42, and a driving section 43.

More specifically, as shown in FIGS. 2 to 5, the first and the second driven sections 41 and 42 are in the form of a polygon and, for example, in the form of a regular pentagon and are projected to an outer periphery of the shaft end 32*b*. It is preferable to form the first and the second driven sections 41 and 42 in a regular polygon shape, which has sides exceeding that of the regular pentagon, in order to reduce associated movement of the crown shaft 32 with the turn of the crown head 33 in a state in which the first driven section 41 or the second driven section 42 and the driving section 43 are fitted with each other. The first and the second driven sections 41 and 42 and the crown shaft 32 are provided with a predetermined interval in the axial direction. The first and the second driven sections 41 and 42 are provided to be opposed to each other in an axial direction of the crown shaft 32 with positions thereof not deviating in a peripheral direction of the crown shaft 32. The predetermined interval is equal to a dimension of movement in the axial direction of the crown head 33. The sides of the first and the second driven sections 41 and 42 extend forming tangent lines with respect to an outer peripheral surface of the shaft end 32*b* located between the first and the second driven sections 41 and 42.

Figure 4:
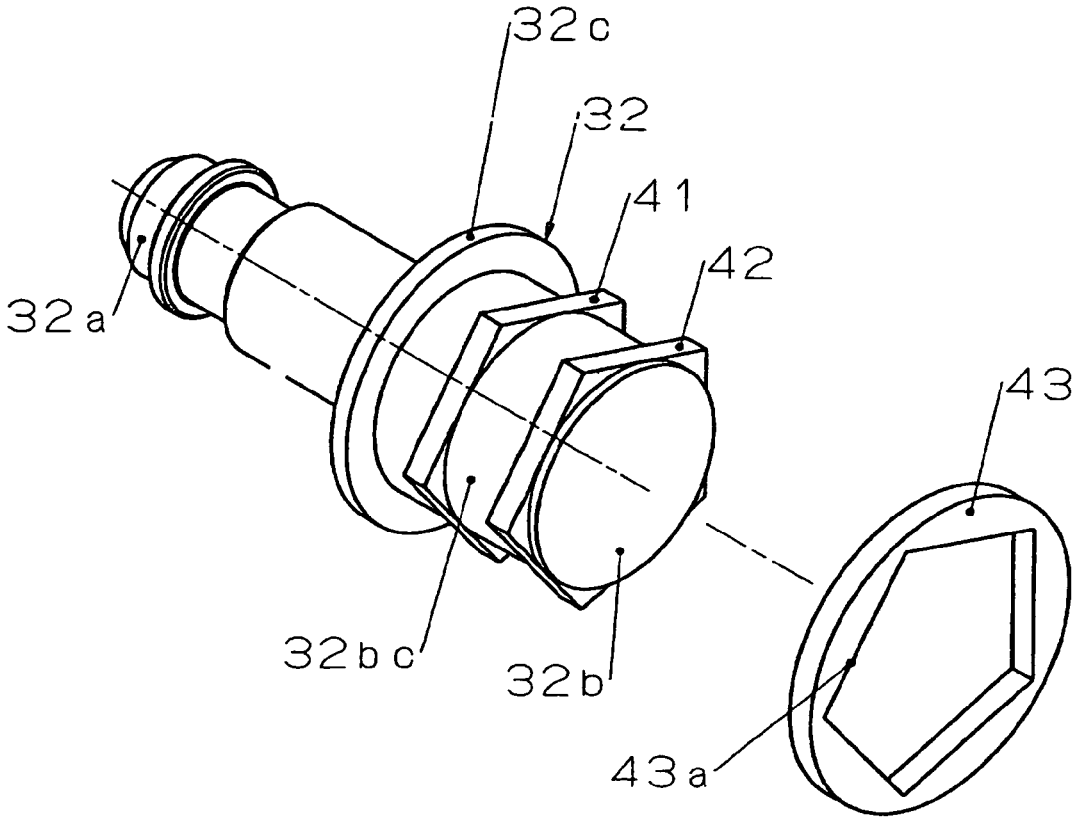
FIG. 4 is a perspective view showing a clutch of the wristwatch according to the first embodiment with the clutch shown in a disassembled state.

The driving section 43 engages with and disengages from the first and the second driven sections 41 and 42 selectively, has a fitting hole 43*a* of the same shape as the first and the second driven sections 41 and 42, that is, the regular pentagon as illustrated in FIG. 4 in the case of this embodiment, and is provided in the crown head 33. This driving section 43 is formed of a ring of metal, for example, stainless steel having the fitting hole 43*a* and is fixed to an inner periphery at the other end on the opposite side of one end, where the female screw section 38 of the crown head 33 is provided by, for example, caulking. Due to this caulking, a visually recognizable joint trace 43*b* of a ring shape appears on the end face of the crown head 33. Such fixing of the driving section 43 is preferable in appearance because the fixing can contribute to giving impression that the crown head 33 is machined with a lot of trouble.

A shaft portion 32*bc* between the first and the second driven sections 41 and 42 of the shaft end 32*b* is made in a thickness inscribing each side of the fitting hole 43*a* included in the driving section 43. Consequently, since the driving section 43 is guided to the shaft portion 32*bc* when the crown head 33 is moved in the axial direction, the crown head 33 can be moved in the axial direction easily and smoothly while controlling fluctuation in a posture of the crown head 33 such as inclination. Therefore, engagement and disengagement operations of the fitting hole 43*a* of the driving section 43 with respect to the first and the second driven sections 41 and 42 are easy.

The coil spring 35 is nipped between the receiving section 32*c* and the driving section 43, which are opposed to each other in the axial direction of the crown shaft 32, and is provided while always biasing the crown head 33 in a direction in which the crown head 33 moves away from the outside surface 14*b* of the case band 14.

Figure 5:
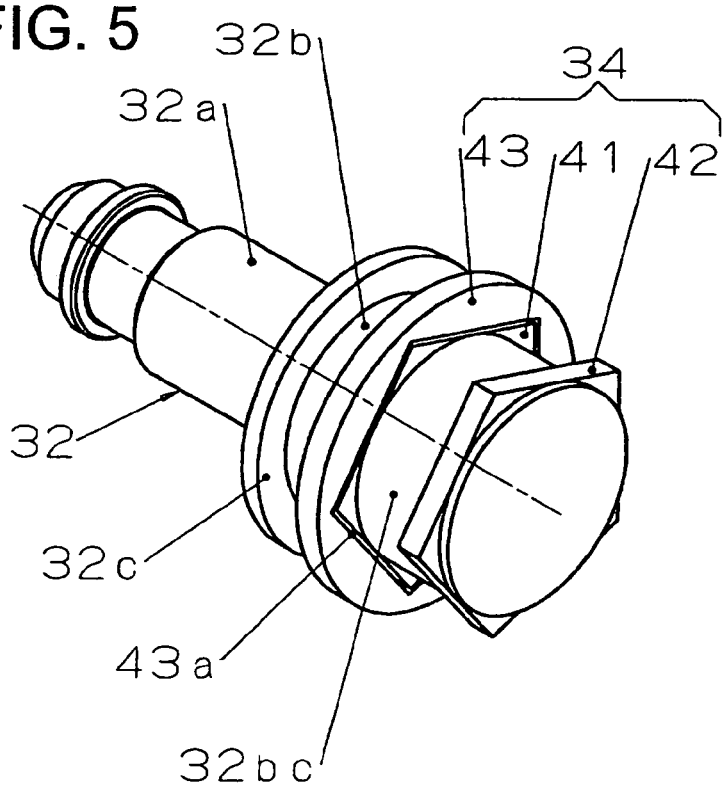
FIG. 5 is a perspective view showing the clutch in FIG. 4 in a first coupling state.

In the wristwatch 10 including the above-mentioned structure, a state in which the crown 31 is arranged in a position where the crown 31 is not pulled out (generally referred to as a "zero stage") is shown in FIG. 2. In this "zero stage", the female screw section 38 of the crown head 33 is engaged with the male screw section 24 of the pipe 21, and the one end face 33*a* of the crown head 33 is positioned in contact with the outside surface 14*b* of the case band 14, and moreover, the fitting hole 43*a* of the driving section 43 of the clutch 34 is fitted in an outer periphery of the first driven section 41 (this fitting state is shown in FIG. 5).

Consequently, in a state in which the coil spring 35 is compressed strongly between the driving section 43 and the receiving section 32*c* of the crown shaft 32, regardless of the fact that the crown head 33 is biased in the direction in which the crown head 33 moves away from the case band 14, the crown head 33 is not moved in the axial direction because of the engagement. At the same time, since the clutch 34 is in the first coupling state, and the fitting hole 43*a* of the driving section 43 and the first driven section 41 are engaged with each other, the crown shaft 32 is prevented from turning with respect to the crown head 33. In this way, in the "zero stage", the crown 31 is in the screw lock state. In this screw lock state, as shown in FIGS. 1 and 2, a part of the shaft end 32*b* of the crown shaft 32 projects from the crown head 33. Consequently, a user is capable of visually recognizing that the crown 31 is in the screw lock state, in which the crown 31 is held so as not to be turned carelessly, according to a positional relation of the shaft end 32*b* of the crown shaft 32 with respect to the end face of the crown head 33.

When time setting for the watch movement 13 is performed, the crown 31 in the screw lock state is pulled out to the position, which generally referred to as the "first stage", and turned. That is, first, the crown head 33 is turned in a loosening direction to bring the crown head 33 into a state in which the female screw section 38 thereof is disengaged from the male screw section 24 of the pipe 21. In this case, in an initial stage of the turn of the crown head 33 in the loosening direction, since the driving section 43 and the first driven section 41 are fitted with each other, the crown shaft 32 is turned in association with the crown head 33. However, the crown head 33 moves axially in a direction in which the crown head 33 moves away from the outside surface 14*b* of the case band 14 in accordance with the turn in the loosening direction thereof, the fitting of the driving section 43 and the first driven section 41 is released promptly in the initial stage. Consequently, the transmission of a turning force to the watch movement 13 according to the association of the crown shaft 32 with the crown head 33 turned in the loosening direction is substantially negligible.

The fitting of the driving section 43 and the first driven section 41 is released as described above, whereby the first coupling state of the crown shaft 32 and the crown head 33 by the clutch 34 is released. Simultaneously with this, the crown head 33 is moved easily without a manual operation along the axial direction of the crown shaft 32 by a spring force (biasing force) of the coil spring 35. The crown shaft 32 is never turned following this movement in the axial direction.

In accordance with this movement in the axial direction of the crown head 33, the clutch 34 comes into the second coupling state to couple the crown shaft 32 and the crown head 33. That is, the fitting hole 43*a* of the driving section 43 is fitted to an outer periphery of the second driven section 42. Simultaneously with this second coupling state being created, the end 38*a* of the female screw section 38 comes into abutment against the receiving section 32*c* of the crown shaft 32, and the movement in the axial direction of the crown head 33 is regulated. The crown head 31 released from the screw lock state is held in the pulled-out position, which is generally referred to as the "first stage", by positioning according to this regulation as shown in FIG. 3. This is preferable in that the second coupling state is maintained by the spring force of the coil spring 35 even if a hand is lifted during a time-setting operation to be explained next.

The crown 31 can be turned manually in this pulled-out position. That is, in the second coupling state in which the fitting hole 43*a* of the driving section 43 is fitted to the outer periphery of the second driven section 42, turn of the crown head 33 is transmitted to the crown shaft 32 via the clutch 34. Since a turning force is given to the watch movement 13 via the winding stem 36 following the transmission of the turn, adjustment of time-setting or the like for this watch movement 13 can be performed.

After this adjustment, the crown 31 is brought into the lock state (see FIG. 2) again. An operation for obtaining this screw lock state is carried out by pushing back the crown head.33 in the direction of the case band 14 against the coil sprig 35, and then the female screw section 38 of this crown head 33 is turned in a tightening direction to screw the female screw section 38 into the male screw section 24 of the pipe 21. Consequently, the one end face 33*a* of the crown head 33 comes into abutment against the outside surface 14*b* of the case band 14, and the clutch 34 comes into the first coupling state immediately before this abutment. Thus, the crown 31 can be brought into the screw lock state so as not to be turned carelessly at the time when the wristwatch 10 is carried or the like.

In this operation for obtaining the screw lock state, the clutch 34 is released from the second coupling state of the crown head 33 and the crown shaft 32 in the early stage of the turn of the crown head 33. In addition, immediately before completion of engagement of the male screw section 24 and the female screw section 38, the clutch 34 comes into the first coupling state for coupling the crown head 33 and the crown shaft 32. Then, the transmission of the crown head 33 is never transmitted to the crown shaft 32 in most of the period in which the crown head 33 is turned in the tightening direction, that is, from a point when the clutch 34 is released form the second coupling state until the clutch 34 comes into the first coupling state.

Incidentally, in a stage immediately before the engagement of the female screw section 38 with the male screw section 24 is completed, since the clutch 34 comes into the first coupling state, the crown shaft 32 turns following the crown head 33 that is turned in the tightening direction. However, an amount of turn of the crown head 33, which is required from a start point of this following turn until the one end face 33*a* of the screw head 33 comes into abutment against the outside surface 14*b* of the case band 14 and the engagement is completed, is a little. Consequently, the association of the crown shaft 32 with the crown head 33, which is turned in the tightening direction, is substantially negligible.

Therefore, it is possible to control the crown shaft 32 not to turn following the screw lock operation, which has already been described, for obtaining the screw lock state to transmit the turn to the mechanical watch movement 13. Consequently, in the screw lock operation, the spiral spring included in the watch movement 13 is controlled not to be a load. Therefore, for example, even in a state in which the spiral spring is wound up considerably, the screw lock operation for the crown 31 can be performed lightly, and operability is high. Note that, in the case in which the watch movement 13 is not mechanical but has the function of changing an operation mode with the crown 31 arranged in the "zero stage" position, a turning force following the screw lock operation for the crown 31 is controlled not to spread to the watch movement as described above. Thus, an operation mode is never changed carelessly.

In addition, since the screw lock operation in the mechanical clock movement 13 having the spiral spring can be performed lightly as described already, an excessive turning operation force is never applied to the male screw section 24 and the female screw section 38. Thus, durability of these screw sections 24 and 38 can be improved.

Second Embodiment

Figure 6:
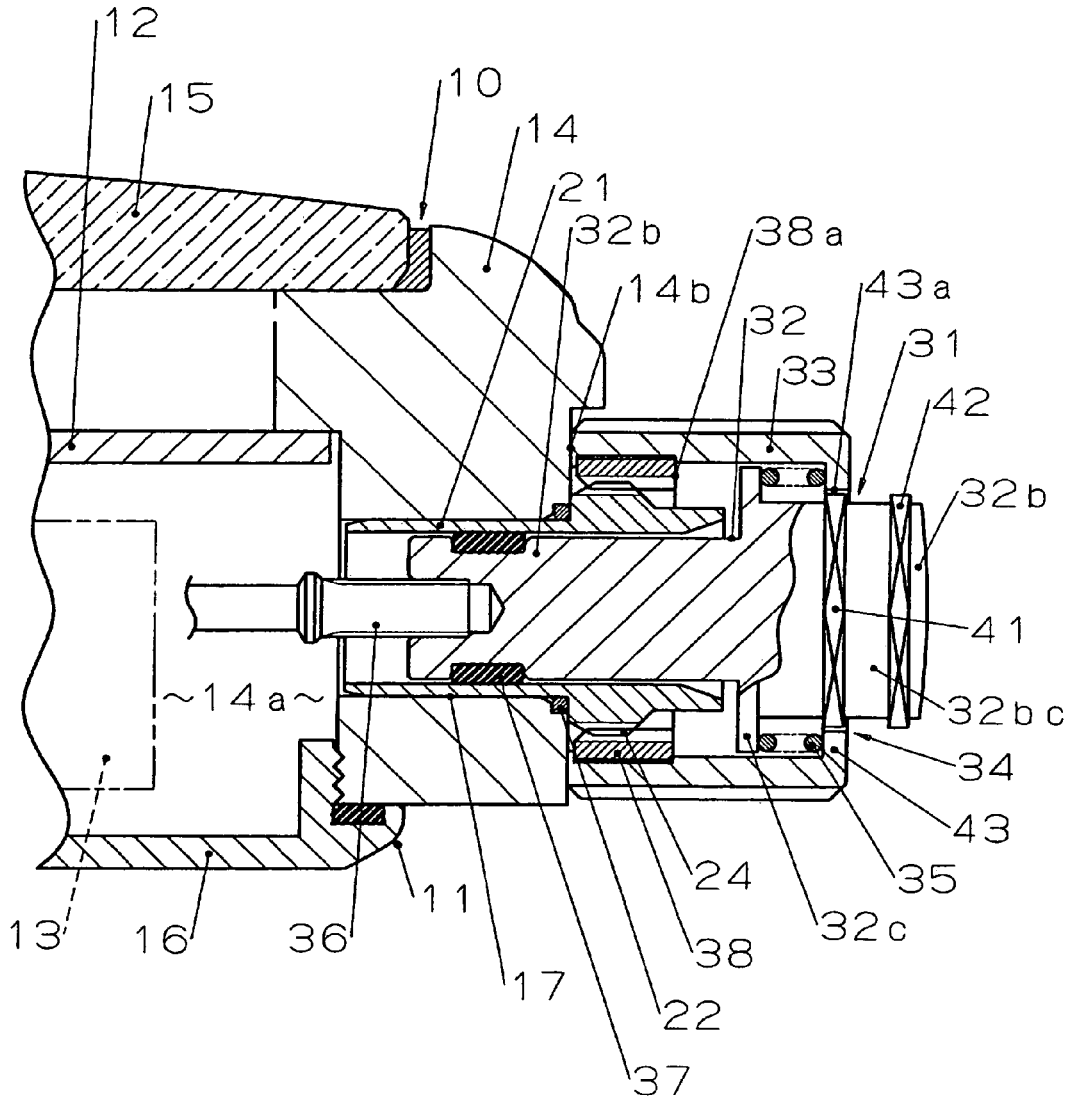
FIG. 6 is a sectional view showing a wristwatch in accordance with a second embodiment of the present invention in a screw lock state of a crown.
Figure 7:
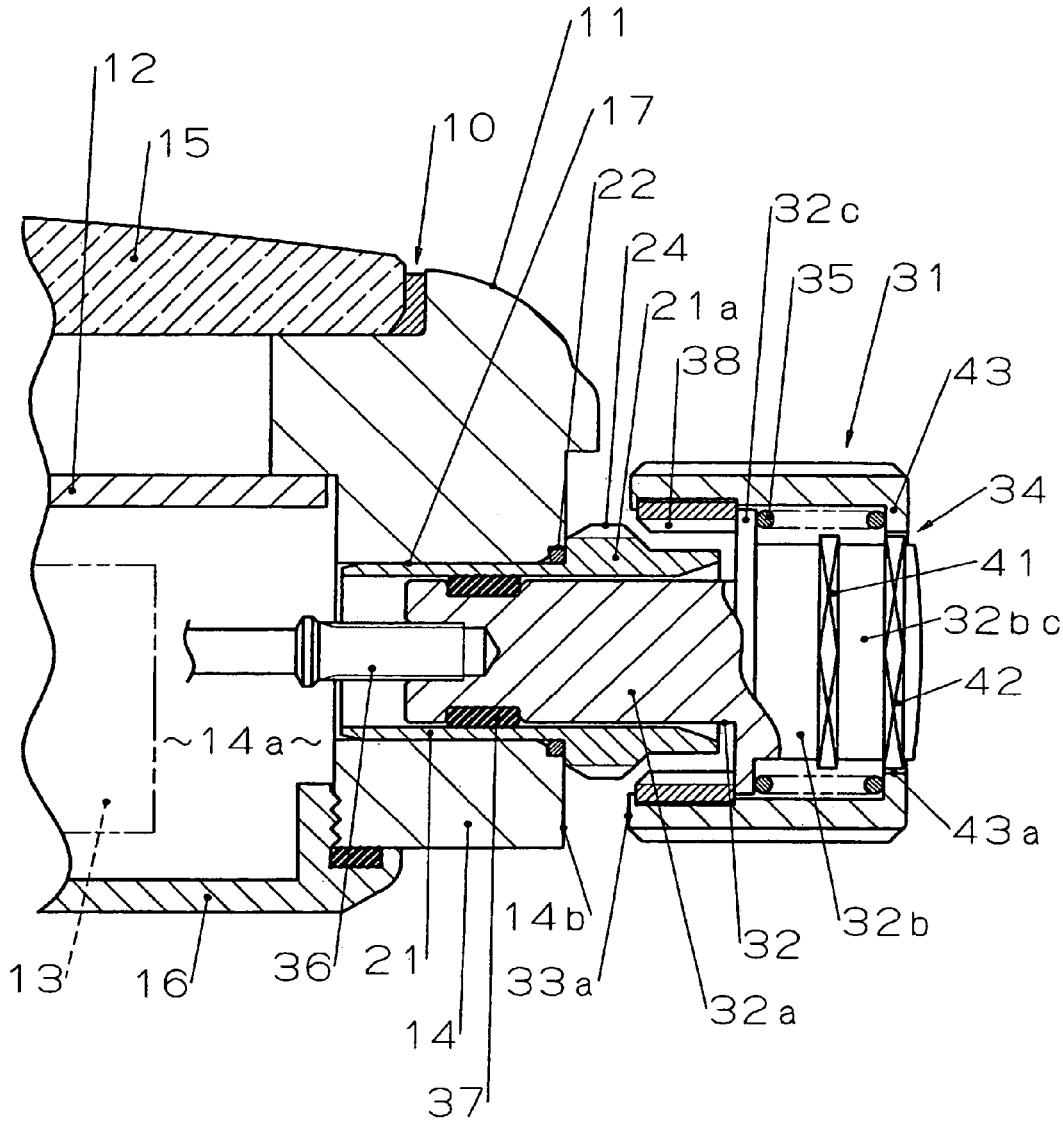
FIG. 7 is a sectional view showing the wristwatch in accordance with the second embodiment of the present invention in a state in which the screw lock state of the crown is released.

A second embodiment of the present invention will be explained with reference to FIG. 6 showing the screw lock state of the crown 31 and FIG. 7 showing a state in which the screw lock state of the crown 31 is released. Since this second embodiment is basically the same as the first embodiment, components same as those in the first embodiment are denoted by reference numerals and signs identical with those in the first embodiment, and an explanation about the components will be omitted. Components different from those in the first embodiment will be explained.

In the second embodiment, the female screw section 38, which is formed in an inner surface of a tubular member (second tubular member) and is provided separately from the crown head 33, is fixed to the inner periphery at one end in the axial direction of the crown head 33 by caulking. Moreover, the driving section 43 of the clutch 34 is formed integrally with the inner periphery at the other end in the axial direction of the crown head 33. Other than the points explained here, the second embodiment including the structures not shown in FIGS. 6 and 7 is the same as the first embodiment.

Therefore, even with the wristwatch 10 of this second embodiment, the same action as the first embodiment can be obtained to solve the problems that the present invention is to solve. Moreover, since the driving section 43 is provided integrally with the crown head 33, there is no deficiency in attachment of the driving section 43 to the crown head 33. Consequently, there is not deficiency in coupling of the crown shaft 32 and the crown head 33 due to the deficiency in attachment, the function of the clutch 34 can be maintained surely over a long-term use, and a caulking trace can be made invisible.

The present invention is not limited to both the embodiments described above. For example, the crown head 33 can be formed in a length that substantially covers the entire outer periphery of the shaft end 32*b* when the crown head 33 is in the screw lock state. In this structure, while maintaining a function of allowing a user to know whether a state of the crown 31 is the screw lock state or the state in which screw lock is released according to a mutual positional relation between the end face of the crown head 33 and the shaft end 32*b* of the crown shaft 32, the second driven section 42 can be made less likely to be operated in the screw lock state to turn the crown shaft 32 carelessly.

In the present invention, the coil spring 35 of the crown 31 may not be provided. In this case, in bringing the crown head 33 into the screw lock state, the crown head 33 is not subjected to resistance of the coil spring. 35. Consequently, the crown head 33 can be moved in the axial direction toward the outside surface 14*b* of the case band 14 with a light operation.

In both the embodiments described above, the first and the second driven sections 41 and 42 of the clutch 34 are formed with regular polygonal projections, and the driving section 43 is constituted to have the regular polygonal fitting hole. Alternatively, in the present invention, the first and the second driven sections 41 and 42 can be formed of external gears, and the driving section 43 can be formed of an internal gear.

According to the present invention, it is possible to control the crown shaft not to turn following the screw lock operation to transmit the turn to the watch movement. Consequently, a portable watch can be provided in which the screw lock operation for the crown can be performed lightly so that durability of the male screw section of the pipe and the female screw section of the crown head can be improved, and moreover, it is possible to hold the crown so not to be turned carelessly or unintentionally by utilizing engagement of screws without being restricted by functions of the watch movement, for example, a function of winding up a spiral spring and a function of changing an operation mode.

What is claimed is:

1. A portable timepiece comprising:

a case having a case band;

a timepiece movement mounted in the case;

a pipe connected to and extending to an exterior of the case band, the pipe having a male screw section;

a winding stem extending into the case for transmitting a rotational force to the timepiece movement; and a crown having a crown shaft connected to rotate the winding stem in response to rotation of the crown shaft, a crown head having a female screw section threadedly engageable with the male screw section of the pipe and mounted for undergoing rotation to rotate the crown shaft in a state in which the male and female screw sections are disengaged from one another, and a clutch for coupling together the crown shaft and the crown head to prevent rotation of the crown shaft in a state in which the male and female screw sections are threadedly engaged with one another and for coupling the crown shaft and the crown head to allow the crown shaft to rotate in response to rotation of the crown head in a state in which the male and female screw sections are disengaged from one another, the clutch comprising first and second driven sections provided on the crown shaft and disposed parallel to each other in an axial direction of the crown shaft, and a driving section having a fitting hole formed in the crown head for selective engagement with the first and the second driven sections during movement of the crown head in the axial direction, the crown shaft having a receiving section disposed on an outer periphery thereof at a position closer to an exterior surface of the case band than the clutch so that an end of the female screw section of the crown head comes into contact with the receiving section of the crown shaft following movement of the crown head in the axial direction thereof in a state in which the male screw section of the pipe is disengaged from the female screw section of the crown head, and the receiving section and the driving section being arranged so as to be opposed to each other in the axial direction of the crown head; and an elastic body disposed between the receiving section and the driving section for biasing the crown head in a direction away from the exterior surface of the case band.

2. A portable timepiece according to claim 1; wherein the crown shaft has a shaft portion disposed between the first and the second driven sections and configured to extend through the fitting hole of the driving section.

3. A portable timepiece according to claim 1; wherein the driving section comprises a ring-shaped member integrally connected to an inner periphery of the crown head.

4. A portable timepiece according to claim 1; wherein the driving section is formed in one piece with the crown head.

5. A portable timepiece comprising:

a case having a case band;

a timepiece movement mounted in the case;

a pipe connected to and extending to an exterior of the case band, the pipe having a male screw section;

a winding stem extending into the case for transmitting a rotational force to the timepiece movement; and a crown having a crown shaft connected to rotate the winding stem in response to rotation of the crown shaft, a crown head having a female screw section threadedly engageable with the male screw section of the pipe and mounted for undergoing rotation to rotate the crown shaft in a state in which the male and female screw sections are disengaged from one another, and a clutch for coupling together the crown shaft and the crown head to prevent rotation of the crown shaft in a state in which the male and female screw sections are threadedly engaged with one another and for coupling the crown shaft and the crown head to allow the crown shaft to rotate in response to rotation of the crown head in a state in which the male and female screw sections are disengaged from one another, the clutch comprising first and second driven sections provided on the crown shaft and disposed parallel to each other in an axial direction of the crown shaft, and a driving section having a fitting hole formed in the crown head for selective engagement with the first and the second driven sections during movement of the crown head in the axial direction, the crown shaft having a receiving section disposed on an outer periphery thereof at a position closer to an exterior surface of the case band than the clutch so that an end of the female screw section of the crown head comes into contact with the receiving section of the crown shaft following movement of the crown head in the axial direction thereof in a state in which the male screw section of the pipe is disengaged from the female screw section of the crown head, and the first driven section being spaced-apart from the second driven section at a distance equal to a range of movement of the crown head in the axial direction thereof.

6. A portable timepiece according to claim 5; wherein the portable timepiece comprises a wristwatch.

7. A portable timepiece according to claim 5; wherein each of the first and second driven sections has a polygon-shaped outer circumferential surface; and wherein the driving section has an inner circumferential surface having a shape conforming to the polygon-shape of the outer circumferential surface of each of the first and second driven sections.

8. A portable timepiece comprising:

a case;

a timepiece movement mounted in the case;

a first tubular member connected to and extending to an exterior of the case, the first tubular member having a male threaded section formed on an outer periphery thereof;

a winding stem extending into the case for transmitting a rotational force to the timepiece movement;

a crown connected to the winding stem for rotational movement therewith, the crown having a crown shaft for rotating the winding stem in response to rotation of the crown shaft and a crown head mounted for undergoing rotation to rotate the crown shaft;

a second tubular member integrally connected to an inner peripheral surface of the crown for rotational movement therewith, the second tubular member having a female threaded section threadedly engageable with the male threaded section of the first tubular member to prevent unintentional rotation of the crown and being disengageable from the male threaded section to permit rotation of the crown to rotate the crown shaft; and a clutch for coupling together the crown shaft and the crown head to prevent rotation of the crown shaft in a state in which the male threaded section of the first tubular member is threadedly engaged with the female threaded section of the second tubular member, and for coupling the crown shaft and the crown head to allow the crown shaft to rotate in response to rotation of the crown head in a state in which the male threaded section of the first tubular member is disengaged from the female threaded section of the second tubular member, the clutch member comprising first and second driven sections provided on the crown shaft and disposed parallel to each other in an axial direction of the crown shaft, and a driving section having a fitting hole formed in the crown head for selective engagement with the first and the second driven sections during movement of the crown head in the axial direction, the first driven section being spaced-apart from the second driven section at a distance equal to a range of movement of the crown head in the axial direction thereof.

9. A portable timepiece according to claim 8; wherein each of the first and second driven sections has a polygon-shaped outer circumferential surface; and wherein the driving section has an inner circumferential surface having a shape conforming to the polygon-shape of the outer circumferential surface of each of the first and second driven sections.

10. A portable timepiece according to claim 8; wherein the crown shaft has a shaft portion disposed between the first and the second driven sections and configured to extend through the fitting hole of the driving section.

11. A portable timepiece according to claim 8; wherein the driving section comprises a ring-shaped member integrally connected to an inner periphery of the crown head.

12. A portable timepiece according to claim 8; wherein the driving section is formed in one piece with the crown head.

13. A portable timepiece according to claim 8; wherein the portable timepiece comprises a wristwatch.

14. A portable timepiece comprising:

a case;

a timepiece movement mounted in the case;

a first tubular member connected to and extending to an exterior of the case, the first tubular member having a male threaded section formed on an outer periphery thereof;

a winding stem extending into the case for transmitting a rotational force to the timepiece movement;

a crown connected to the winding stem for rotational movement therewith, the crown having a crown shaft for rotating the winding stem in response to rotation of the crown shaft and a crown head mounted for undergoing rotation to rotate the crown shaft;

a second tubular member integrally connected to an inner peripheral surface of the crown for rotational movement therewith, the second tubular member having a female threaded section threadedly engageable with the male threaded section of the first tubular member to prevent unintentional rotation of the crown and being disengageable from the male threaded section to permit rotation of the crown to rotate the crown shaft; and a clutch for coupling together the crown shaft and the crown head to prevent rotation of the crown shaft in a state in which the male threaded section of the first tubular member is threadedly engaged with the female threaded section of the second tubular member, and for coupling the crown shaft and the crown head to allow the crown shaft to rotate in response to rotation of the crown head in a state in which the male threaded section of the first tubular member is disengaged from the female threaded section of the second tubular member, the clutch member comprising first and second driven sections provided on the crown shaft and disposed parallel to each other in an axial direction of the crown shaft, and a driving section having a fitting hole formed in the crown head for selective engagement with the first and the second driven sections during movement of the crown head in the axial direction, the receiving section and the driving section being opposed to each other in the axial direction of the crown head; and an elastic body disposed between the receiving section and the driving section for biasing the crown head in a direction away from the exterior surface of the case.

* * * * *